US010508492B2

(12) United States Patent
Barnard

(10) Patent No.: US 10,508,492 B2
(45) Date of Patent: Dec. 17, 2019

(54) COATINGS FOR FLUID ENERGY DEVICE COMPONENTS

(71) Applicant: Barson Composites Corporation, Old Bethpage, NY (US)

(72) Inventor: Dana Emerson Barnard, Santa Fe, NM (US)

(73) Assignee: BARSON COMPOSITES CORPORATION, Old Bethpage, NY (US)

( * ) Notice: Subject to any disclaimer, the term of this patent is extended or adjusted under 35 U.S.C. 154(b) by 748 days.

(21) Appl. No.: 13/974,461

(22) Filed: Aug. 23, 2013

(65) Prior Publication Data

US 2014/0054091 A1 Feb. 27, 2014

Related U.S. Application Data

(60) Provisional application No. 61/692,993, filed on Aug. 24, 2012.

(51) Int. Cl.
*E21B 4/02* (2006.01)
*B05D 1/36* (2006.01)
(Continued)

(52) U.S. Cl.
CPC ..... *E21B 4/02* (2013.01); *B05D 1/36* (2013.01); *F01C 21/08* (2013.01); *F04C 2/1073* (2013.01);
(Continued)

(58) Field of Classification Search
CPC ... E21B 4/02; B05D 1/36; F01C 21/08; F04C 2/1073; F04C 2/1075; F04C 13/008;
(Continued)

(56) References Cited

U.S. PATENT DOCUMENTS 5,171,138 A 12/1992 Forrest
5,645,896 A 7/1997 Mills
(Continued)

OTHER PUBLICATIONS

Accessed Tungsten, Cobalt, and More on Mohs Scale of Mineral Hardness on Jul. 27, 2016 via www.larsonjewelers.com.*
(Continued)

*Primary Examiner* — David J Bagnell
*Assistant Examiner* — Manuel C Portocarrero
(74) *Attorney, Agent, or Firm* — Reising Ethington P.C.

(57) ABSTRACT

A coated component for use in a fluid energy device includes a coating system with multiple layers of coating material, including a soft material such as a polymer coated over a hard material such as a metal. The fluid energy device can be a fluid motor or fluid pump, and the coated component can be a rotor or a stator. The hard and soft materials may be interlocked with each other and/or with an interposed porous layer. The presence of the soft material can reduce or eliminate the need for meticulous polishing operations typically required with as-applied hard materials while improving the longevity of mating fluid energy device components. The mating components are exposed only to the soft material in the initial stages of operation, after which the soft material wears away to gradually expose the mating components to the hard material in a less abrasive manner.

20 Claims, 3 Drawing Sheets

(51) Int. Cl.
*F01C 21/08* (2006.01)
*F04C 2/107* (2006.01)
*F04C 13/00* (2006.01)

(52) U.S. Cl.
CPC ..... *F04C 2/1075* (2013.01); *F04C 13/008* (2013.01); *F04C 2230/91* (2013.01); *F04C 2240/20* (2013.01); *F05C 2251/02* (2013.01); *F05C 2251/10* (2013.01); *Y10T 428/24983* (2015.01)

(58) Field of Classification Search
CPC ..... F04C 2230/91; F04C 2240/20; F05C 2251/02; F05C 2251/10; Y10T 428/24983; C23C 4/10; C23C 4/06; C23C 4/129; C23C 4/18
USPC ..... 427/450
See application file for complete search history.

(56) References Cited

U.S. PATENT DOCUMENTS 6,604,922 B1 8/2003 Hache
2006/0105015 A1* 5/2006 Perla ..... A61L 27/32 424/423
2009/0016893 A1 1/2009 Lee et al.
2009/0152009 A1* 6/2009 Slay ..... C08K 5/549 175/107
2010/0038142 A1 2/2010 Snyder et al.
2010/0129636 A1* 5/2010 Cybulsky ..... C04B 41/009 428/310.5
2011/0044821 A1* 2/2011 Rowe ..... C23C 4/02 416/241 R
2012/0018227 A1* 1/2012 Puzz ..... E21B 4/02 175/107
2013/0131824 A1* 5/2013 Meehan ..... C23C 4/12 623/23.5

OTHER PUBLICATIONS

Definition of "mud" accessed on Jul. 27, 2016 from Schlumberger Oilfield Glossary via www.glossary.oilfield.slb.com/.*
International Search Report for application No. PCT/US2013/056398, dated Aug. 23, 2013, 3 pages.
Written Opinion of the International Searching Authority for application No. PCT/US2013/056398, dated Aug. 23, 2013, 7 pages.

* cited by examiner

COATINGS FOR FLUID ENERGY DEVICE COMPONENTS

CROSS-REFERENCE TO RELATED APPLICATION

This application claims the benefit of U.S. Provisional Patent Application No. 61/692,993 filed Aug. 24, 2012, the entire contents of which are hereby incorporated by reference.

TECHNICAL FIELD

This disclosure generally relates to coatings for use with fluid energy device components, particularly those components that come into contact with the working fluid.

BACKGROUND

In some fluid energy devices, such as hydraulic devices, the working fluid flowing through the device during operation is corrosive and/or abrasive. This fluid comes into contact with certain components of the device and can attack, degrade, or otherwise damage component surfaces over time. Hydraulic devices are often used in relatively heavy-duty applications with large and expensive equipment, making reliability important due to the time and costs typically associated with the repair of such equipment and with lost revenue associated with equipment downtime.

SUMMARY

In accordance with one or more embodiments, a coated component for use in a fluid energy device includes a component substrate and a hardcoat layer of coating material disposed over the component substrate. The hardcoat layer of coating material has a hardness greater than the hardness of the component substrate. The coated component further includes a softcoat layer of coating material disposed over the hardcoat layer that has a hardness less than the hardness of the hardcoat layer.

In accordance with one or more embodiments, a method of making a coated component for use in a fluid energy device includes the steps of: (a) applying a hardcoat layer of material over a component substrate, the hardcoat layer being harder than the component substrate; and (b) applying a softcoat layer of material over the component substrate so that the softcoat layer interlocks with the hardcoat layer or with an interposed porous interlayer.

In accordance with one or more embodiments, a coated component for use in a fluid energy device includes a coating system coated over a component substrate. The coating system has an interlocking portion that includes a polymeric material in an interlocking arrangement with a metallic material, and the metallic material is harder than the component substrate.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The coating system described below may be used on fluid energy device components such as rotors and/or stators of fluid motors or pumps. In a fluid motor, fluid pressure is converted to mechanical motion as a working fluid flows therethrough. A fluid pump works similarly, but in reverse, with mechanical motion of one or more pump components pressurizing a fluid as it flows through the pump. For purposes of this description, both are considered fluid energy devices, as each either extracts energy from or imparts energy to the fluid that flows through it. Where the fluid is a liquid, these devices may be referred to as hydraulic devices. While the following description makes reference to hydraulic devices as illustrative examples, the coating system taught herein may be employed with other fluid energy devices, particularly in applications where surface wear and/or corrosion is a concern, such as gerotor pumps, plastics extrusion screws, Archimedes screw pumps, etc. The coating system may also be useful in applications outside of fluid energy devices, such as gears, frictional devices, bearing surfaces, or other applications.

Figure 1:
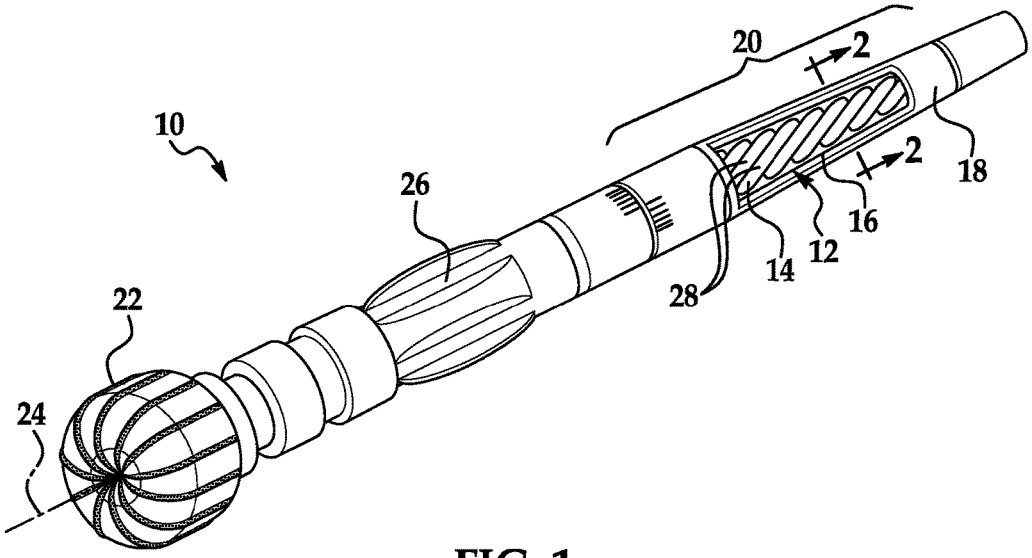
FIG. 1 is a perspective view of the working end of an subterranean drilling tool, including a hydraulic motor that may include one or more components having a coating system as described herein.

Referring to FIG. 1, there is shown the working end of a subterranean drilling tool 10 that includes a hydraulic motor 12, according to one embodiment. The illustrated drilling tool 10 is of the type used in deep underground oil drilling or gas discovery operations. Used with sophisticated sensors, telemetric equipment, tilting joints, and control systems, such drilling tools are capable of directional drilling, in which the working end of the tool is remotely steered to depths of nearly 20,000 feet below ground level. Tool reliability is important in such applications, as any time spent retrieving the working end of the drilling tool for component replacement or repair is lost time, and steering the tool miles beneath the surface back to the location it left off can also be time-consuming. The hydraulic motor 12 in this example includes a rotor 14 and a stator 16 disposed within a housing 18 as part of a power section 20 of the drilling tool. The motor 12 is coupled to a drill bit 22 so that the drill bit rotates about an axis 24 when the motor is powered. The drilling tool 10 may include other components and/or sections, such as a transmission section 26 that can house bearings, shafts, couplings, flow restrictors, filters, or other components. The transmission section 26 may optionally rotate independently from and/or in conjunction with the motor 12. In operation, a working fluid is pumped through the motor 12 from above ground and, more particularly, through the space between the rotor 14 and the stator 16. In this example, the rotor 14 includes a plurality of outward lobes 28, with each lobe arranged in a helical or twisted configuration along the length of the rotor 14. This lobe configuration causes the rotor 14 to move inside the stator 16 when subjected to fluid pressure.

Figure 2:
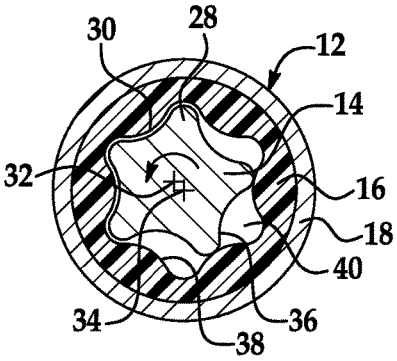
FIG. 2 is a cross-section of the hydraulic motor of FIG. 1, including a rotor that rotates within a stator during operation.

FIG. 2 is a cross-sectional view of the hydraulic motor 12, showing the rotor 14 within the stator 16. The stator 16 is shaped to fit the rotor 14 and includes a plurality of inward lobes 30 along its length in a complimentary helical configuration so that each lobe 30 can fit snugly between successive outward lobes 28 of the rotor. In this example, the number of stator lobes is one more than the number of lobes on the 5-lobed rotor 14. In any transverse reference plane along the length of the rotor 14, fluid pressure causes the rotor to rotate about its own center 32, shown as counterclockwise rotation in FIG. 2 as indicated by the unnumbered arrow. The interaction of the respective lobes 28, 30 causes the center 32 of the rotor 14 to rotate about the center 34 of the stator 16 in the opposite direction—clockwise in the example of FIG. 2. In cross-section, as shown, the movement of the rotor 14 within the stator 16 is like that of a gear set, where the opposing lobes 28 and 30 mesh with one another like gear teeth as the rotor turns. An outer surface 36 of the rotor 14 is in continuous contact with an inner surface 38 of the stator 16, and a cavity 40 is at least partly defined between these opposing surfaces 36, 38. Depending on the number of lobes and on the length of the hydraulic motor 12, a plurality of such cavities 40 may be formed along the length of the motor. The movement of the rotor 14 in this example may be characterized as eccentric motion, and each cavity 40 is a moving cavity during operation. In other words, each cavity full of working fluid moves along the length of the motor 12 in a helical path around the rotor 14. The fluid pump analog of the illustrated fluid motor—i.e. a pump in which a similarly configured rotor is rotated mechanically to transport fluid from one end of the rotor to the other—may thus be referred to as a progressive cavity pump (PCP) or a progressive cavity positive displacement pump (PCPD pump).

Figure 3A:
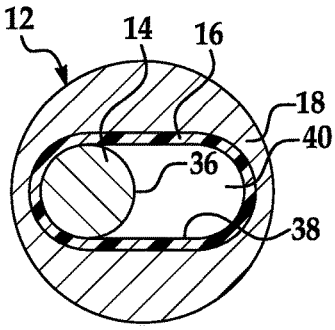
FIGS. 3A-3C are cross-sectional views of other exemplary rotors and stators.
Figure 3B:
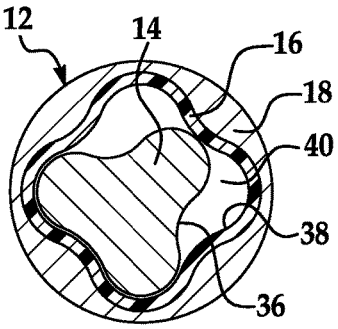
Figure 3C:
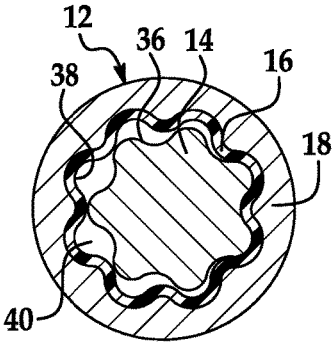

FIGS. 3A-3C are cross-sectional views of other rotor 14 and stator 16 pairs that may be used in drilling tools or other similar fluid energy devices. FIG. 3A illustrates a single-lobed rotor, FIG. 3B illustrates a three-lobed rotor, and FIG. 3C illustrates a seven-lobed rotor. Each rotor 14 is disposed within a stator 16 having one more lobe than its mating rotor. The single-lobed rotor of FIG. 3A is a special case in which the cross-section of the rotor is circular so that the entire rotor is a single, circular lobe. In that particular case, the flat portions of the slot-shaped stator are equivalent to the inward lobes of the multi-lobed stators. Five, seven, and nine-lobed rotors are common among hydraulic motors in drilling tool applications. As with the example of FIG. 2, each of the rotor and stator pairs of FIGS. 3A-3C are disposed within a housing 18. Though not limited to particular materials, the rotor 14 and the housing 18 are typically metal components, and the stator 16 may be formed from or lined with an elastomeric material, such as nitrile butadiene rubber (NBR) or other suitable material to help form a tight seal with the rotor 14.

In drilling applications, the working fluid may be the same fluid as the drilling fluid that is used to lubricate and cool the drill bit and carry the crushed or cut pieces of earth back to the surface. For example, in the drilling tool of FIG. 1, drilling fluid flows through the hydraulic motor 12 in a direction toward the drill bit 22 and out of one or more openings near the end of the drill bit. The drilling fluid then travels back to the surface of the earth along the drilled hole via the annulus surrounding the drilling tool or drill string, carrying the drilling debris therewith. Such drilling fluids may be referred to as drilling mud. Drilling mud sometimes includes suspended particles of clay or other chemicals that impart the fluid with other useful characteristics, such as a desired viscosity, gel-like consistency, etc. Suspended particles may be abrasive, and certain chemicals may be corrosive. These or other types of additives, or the base fluid itself, can accelerate the wear and tear of the rotor 14 and/or the stator 16, thus reducing their useful service life. For example, as one or both of the opposing surfaces of the rotor and stator are worn away, the tight seal between the rotor and stator may be compromised so that fluid pressure no longer rotates the drill bit with sufficient torque or at all. Component replacement may then be required.

Figure 4:
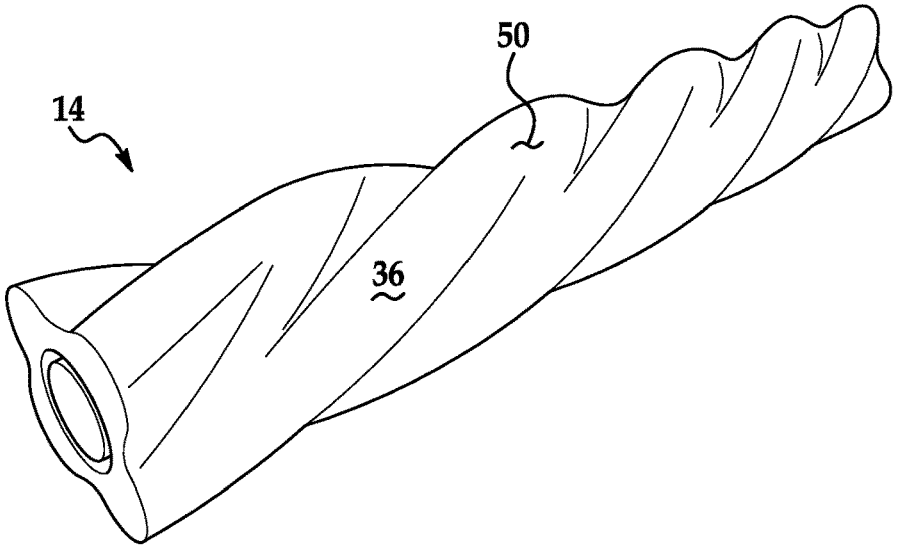
FIG. 4 is a perspective view of an exemplary rotor of a hydraulic device that may include the coating system described herein.

FIG. 4 is a perspective view of an exemplary rotor 14 for use in a drilling tool or other fluid energy device. The illustrated rotor 14 is a four-lobed rotor and may be referred to as a mud rotor or mud pump rotor in drilling applications. Such rotors can be up to about 8 meters in length and are usually several inches in diameter. The rotor 14 includes a rotor substrate (not shown explicitly in FIG. 4) and an overlying coating system 50 that may be useful to extend the service life of the finished rotor compared to uncoated rotors or rotors with conventional coatings. Generally, the rotor substrate is manufactured in the desired final shape of the rotor, as the coating system 50 is relatively thin. It should be understood that the coating system 50 described here may overly any portion or any number of portions of the rotor substrate, including the entire substrate. The coating system 50 may make up the entire portion of the outer surface 36 of the rotor 14 that comes into contact with the stator and/or the working fluid. It should also be understood that the coating system 50 may be used over other wearable component substrates, including that of the stator in some cases.

Figure 5:
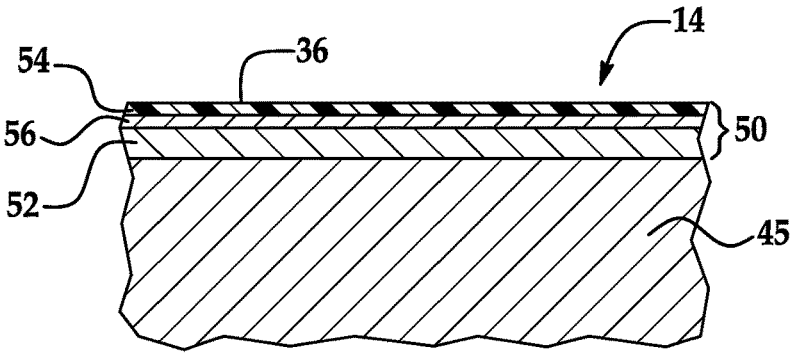
FIG. 5 is a cross-sectional view of a surface portion of a coated substrate, including one embodiment of the coating system.
Figure 6:
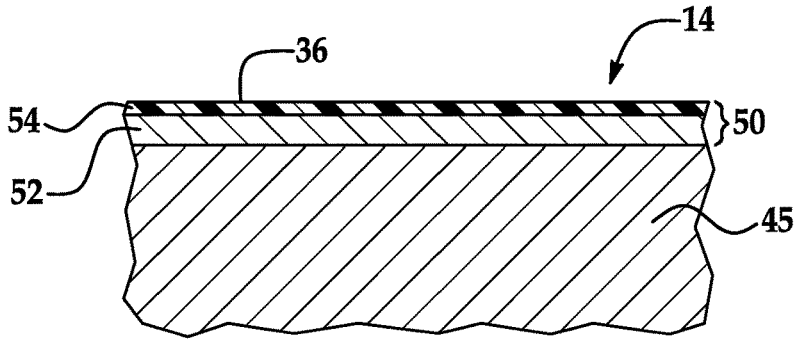
FIG. 6 is a cross-sectional view of a surface portion of a coated substrate, including another embodiment of the coating system.

FIG. 5 is a cross-sectional view of a portion of an exemplary rotor 14, including the outer surface 36. The rotor 14 includes the substrate 45 and the coating system 50, as shown. In this embodiment, the coating system 50 includes a plurality of coating layers 52-56 disposed over the substrate 45. A hardcoat layer 52 is disposed over the substrate 45, and a softcoat layer 54 is disposed over the hardcoat layer. The particular embodiment shown in FIG. 5 includes an optional interlayer 56 between the hardcoat and softcoat layers 52, 54 that can serve as a transition layer as described further below. FIG. 6 illustrates an embodiment of the coating system 50 in which the interlayer is omitted, but the following descriptions of the various layers of the coating system apply to both of FIGS. 5 and 6.

The hardcoat layer 52 is a layer of material that, even in the absence of layers 54 and 56, increases the wear-resistance and/or the corrosion-resistance of the underlying substrate 45 in the given application. The hardcoat layer 52 is formed from a material having a hardness that is higher than that of the underlying substrate 45. In one embodiment, the substrate 45 is formed from steel or stainless steel, and the hardcoat layer 52 is formed from a material having a hardness greater than the particular substrate steel. Suitable hardcoat layers 52 may be formed from materials that comprise a carbide component, such as tungsten carbide or chromium carbide. In one embodiment, the hardcoat layer 52 comprises a mixture or alloy of tungsten carbide, cobalt, and chromium (WC—Co—Cr). In another embodiment, the hardcoat layer 52 comprises a mixture or alloy of chromium carbide, nickel and chrome (CrC—Ni—Cr). The hardcoat layer 52 may consist essentially of WC—Co—Cr or CrC—Ni—Cr. The hardcoat layer 52 may also be formed from ceramic or other materials with hard particles dispersed within a softer metal binder material.

These illustrative hardcoat layer materials can be applied over the substrate 45 by high-velocity (HV) spraying techniques in which particles of the desired material(s) are projected toward the substrate at speeds sufficiently high to cause the particles to deform or flatten upon impact to form the coating layer. In some HV spraying processes, the particles of material are softened with heat prior to impact. Examples of suitable HV spraying processes include high-velocity oxygen fuel spraying (HVOF), high-velocity air fuel spraying (HVAF), high-velocity plasma spraying (HVP), or detonation gun spraying. The hardcoat layer 52 can be formed from other materials suitable for use in HV spraying processes, such as ceramic materials, cermets, or any of a variety of metals or metal alloys. Other coating processes, such as cold spraying, electroplating, slurry coating, arc spraying, combustion spraying, or plasma spraying processes may be used to apply certain types of hardcoat layers, so long as the hardcoat layer bonds sufficiently with the underlying material and is suitably hard to enhance the wear properties of the surface of the coated component. In fact, when combined with the overlying softcoat layer 54 to form the coating system 50, some materials that were previously disfavored as wear-resistant coating materials, due to overly-rough surface finishes, costly pre-coating processes, or other reasons, may be suitable materials for use in the hardcoat layer 52.

The bond strength between the hardcoat layer 52 and the underlying material is preferably greater than 10,000 psi, but this is not always necessary. The hardcoat layer 52 may also be characterized by a low porosity, which may be most apparent with certain spray application processes like HV spraying processes in which the porosity of the deposited coating layer may be somewhat controllable. The hardcoat layer 52 preferably has a porosity of 1% or less—i.e., the bulk volume of the hardcoat layer is preferably 99% or more solid material. The thickness of the hardcoat layer 52 may be in a range from 0.003 inches to 0.008 inches (3-8 mils). The hardcoat layer 52 can be thicker than 8 mils, provided that the bond strength formed with the underlying material is sufficiently high and/or that other application specific requirements are met. The illustrated hardcoat layer 52 is applied directly to the substrate 45, but there could be one or more interposed layers of material as well.

The softcoat layer 54 is a layer of material that is softer than the hardcoat layer 52. The softcoat layer 54 may also have a hardness that is less than or equal to the hardness of the material of the opposing surface in the given application, which is the inner surface of the stator in the examples in the figures. For example, the softcoat layer 54 may be formed from an organic material, such as a polymeric or a polymer-based material, particularly where the opposing stator surface is polymeric and/or elastomeric. In one embodiment, the softcoat layer 54 is formed from a material having a hardness of 75 or less on the Shore A scale. In another embodiment, the softcoat layer 54 is formed from a material having a hardness of 50 or less on the Shore A scale. The softcoat layer 54 may thus be considered at least partly sacrificial in nature as the first material to wear away during component operation.

The softcoat layer 54 may serve to protect the inner surface of the stator during the initial stages of operation—i.e., when the rotor 14 is first put into service. For example, with the hardcoat layer 52 alone, the outer surface of the rotor may be a very rough surface, especially when applied via an HV spraying process with no further surface treatment thereafter. Combined with the relative hardness of the hardcoat layer material, this rough outer surface can quickly damage the soft inner surface of the mating stator. It has been found that without the softcoat layer 54, the hardcoat layer requires additional post-coating treatment, such as a meticulous polishing operation, to smooth the surface enough to prevent extensive stator damage. For example, a rotor with a hardcoat layer alone may require polishing down to a surface roughness in the range of 10 rms or less to prevent damage to the mating elastomeric stator. The relative hardness of the hardcoat material and the complex contours of the rotor lobes can make such a polishing operation accordingly more difficult, expensive, and time-consuming, often requiring diamond-based polishes. The softcoat layer 54 can allow the rotor to have a hardcoat layer 52 sufficient to increase the wear performance of the rotor over time without the need for expensive and time-consuming secondary operations like polishing to smooth the hardcoat layer. The manner in which this combination of hard and soft layers functions will be subsequently described in greater detail.

Suitable softcoat layer 54 materials include nearly any thermoplastic or thermoset polymeric material. It may be preferred that the softcoat layer 54 include one or more polymeric materials with a low coefficient of friction and/or high wear-resistance. Polytetrafluoroethylene (PTFE) or other fluorinated polymers along with their copolymers and alloys are examples of suitable polymeric materials for use in the softcoat layer. Such low friction polymeric materials may be the major component of the finished softcoat layer 54, or they may be less than half of the finished softcoat layer composition with an organic binder component such as a cured or curable polymer in which the low friction material is distributed. The softcoat layer 54 material is preferably applied in liquid form so that it can penetrate any porosity present in the underlying layer(s). For example, the softcoat layer material may be applied as part of a liquid solution or suspension, either organic solvent-based or water-based, with a viscosity sufficiently low to allow penetration into the porosity of the underlying layer. The applied liquid material can form the softcoat layer 54 when the solvent or carrier liquid evaporates and/or reacts with some other component of the applied liquid or the surrounding atmosphere during a curing step. The application process may be similar to a painting process where a thin and relatively low viscosity layer of material is applied and allowed to dry and/or cure.

In one particular embodiment, the softcoat layer 54 is applied in liquid form, and the liquid material includes a friction reducer, such as a fluoropolymer (e.g., PTFE, PEF, PFA, ETFE, etc.), and a curable binder material. The applied liquid is flash dried to remove solvent, then allowed the cure or heated to cure. During the curing step, the binder material and the friction reducer may at least partly stratify or separate from one another. In other words, the friction reducer may migrate toward the outer surface 36. Where the applied material includes a fluoropolymer friction reducer, the fluoropolymer may be sintered during the curing step. The softcoat layer 54 thus may include primarily fluoropolymer at the finished outer surface 36 and primarily binder material nearest the underlying material layer(s).

Additives may be included in the softcoat layer 54 during application, such as a polymer binder, curing agent, a surfactant or wetting agent, friction reducers, high-wear additives, etc. Examples of friction reducers besides fluoropolymers include molybdenum disulfide, or any other materials commonly used in thin film lubricant applications (e.g., silver, bronze, nanoparticles, etc.). Whether the softcoat layer 54 is polymer-based or not, it is preferably corrosion-resistant, hydrophobic, and oleophobic and can be applied and cured at a temperature of 1000° F. or less, and preferably at a temperature between 500° F. and 800° F. Some polymeric materials may be formulated to cure without heat, such as reactive polymer systems, air-cure, or UV-cure materials. Other non-organic materials may be used as the softcoat layer in some instances, such as certain cermet materials and nanocoatings.

Depending on whether the interlayer 56 is included between the hardcoat and softcoat layers 52, 54, the thickness of the softcoat layer 54 is preferably in a range from 0 to 0.0015 inches (0-1.5 mils), which includes its depth of penetration into the underlying layer. For example, depending on the surface roughness of the layer over which the softcoat layer 54 is directly applied, the softcoat layer may have discontinuities where roughness peaks from the underlying layer are present, defining areas of zero thickness for the softcoat layer. The final thickness of the softcoat layer 54 may preferably be minimized so that it penetrates the pores and fills in between roughness peaks in the underlying layer of material. Thus, at the outer surface 36, the softcoat layer 54 may be a discontinuous layer. In at least this manner, the softcoat layer and the underlying hardcoat layer 52 or interlayer 56 may be mutually beneficial. For instance, the softcoat layer 54 helps reduce the otherwise harsh effect of the roughness peaks of the underlying layer, and the harder underlying layer locks the softcoat layer in place so that the softcoat layer is more than simply a continuous overlying layer in sheet form that could easily be peeled away.

The coating system 50 preferably includes the interlayer 56 between the hardcoat and softcoat layers 52, 54, as depicted in FIG. 5. The interlayer 56 may serve as a transition layer between the hard and dense inner layer 52 and the softer outer layer 54. The interlayer 56 may be characterized by a porosity that is higher than that of the hardcoat layer 52, thus providing flow paths into which and through which the material of the softcoat layer 52 can flow during application. The porosity of the interlayer 56 may be in a range from 2% to 10%, or preferably in a range from 4% to 8%. For purposes of this description, the porosity of the interlayer 56 is the same before and after application of the softcoat layer 54. In other words, for purposes of porosity determinations, the pores present in the interlayer 56, as applied, are treated as pores, even after being filled with softcoat layer material.

The interlayer 56 is preferably formed from the same type of material and with the same type of application process as the hardcoat layer 52, but this is not necessary. The interlayer 56 could be the same type of material as the hardcoat layer material but applied by a different process, a different type of material applied by the same process, or a different type of material applied by a different process. The interlayer 56 material should generally meet the same criteria for bond strength and hardness as the hardcoat layer 52 material. In one embodiment, the interlayer 56 is formed from the same material as the hardcoat layer 52 using the same coating process, and the porosity of the interlayer is higher than the porosity of the hardcoat layer. For example, both the hardcoat layer 52 and the interlayer 56 may be formed from a material comprising a carbide component (e.g., WC—Co—Cr or CrC—Ni—Cr) by an HV spraying process, where the process is adjusted to increase the porosity of the applied material after the desired hardcoat layer thickness 52 is achieved. In another example, the hardcoat layer 52 is an HV-sprayed layer comprising or consisting of tungsten carbide, and the interlayer 56 is a plasma-sprayed ceramic layer. Non-HV spraying methods may be more suitable for the interlayer 56 than for the hardcoat layer 52 in some cases due to the higher porosity achieved by non-HV spraying.

The interlayer 56 may range in thickness from 0.0005 inches to 0.002 inches (0.5-2.0 mils). In one embodiment, the interlayer has a thickness that is from 5% to 25% of the thickness of the hardcoat layer. In another embodiment, the hardcoat layer 52 and the interlayer 56 are the same type of material and may be described together as a hard layer of material with the outer 5-20% of the hard layer of material being more porous than the inner 80-95%. The combined thickness of the interlayer 56 and the overlying softcoat layer 54 may range from 0.00075 inches to 0.001 inches (0.75-1 mils). Thus, where the interlayer 56 is present, the thickness of the portion of the softcoat material layer lying on top of or over the interlayer may range from 0 to 0.0005 inches (0-0.5 mils). These are of course only illustrative thickness ranges, as individual layer thicknesses may vary depending on the material type or other factors.

Figure 7:
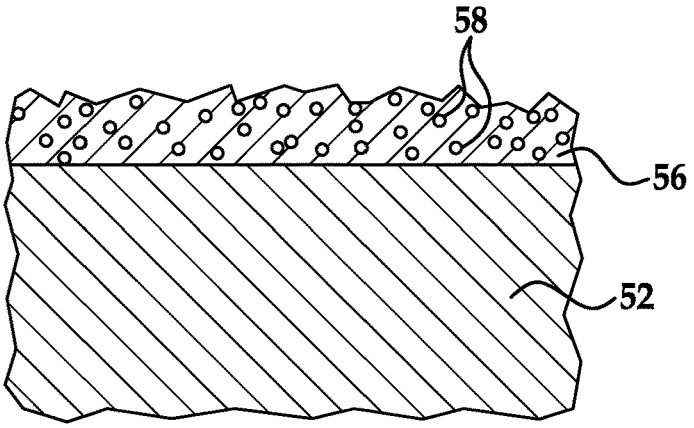
FIG. 7 is an enlarged cross-sectional view of the coating system of FIG. 5, shown after the coating system is partially applied.
Figure 8:
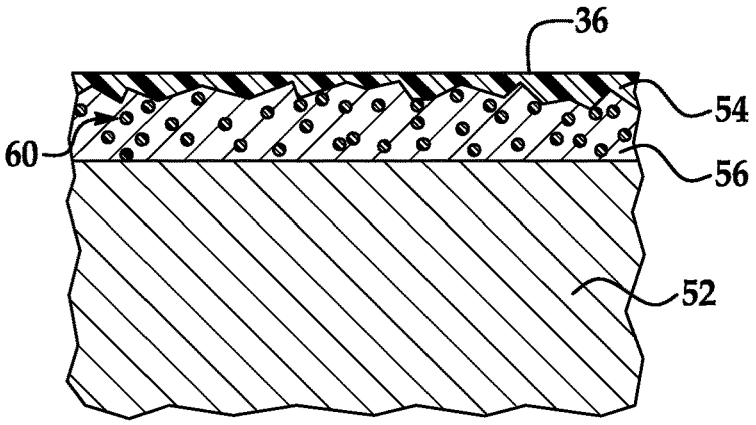
FIG. 8 is the enlarged cross-sectional view of FIG. 7, shown after the coating system is further applied.
Figure 9:
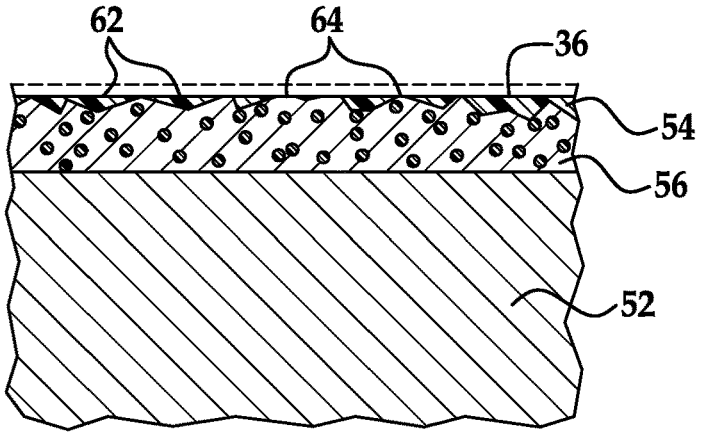
FIG. 9 is the enlarged cross-sectional view of FIG. 8, shown after the coating system has been in use for some period of time.

FIGS. 7-9 are enlarged cross-sectional views of the coating system of FIG. 5 in different stages of application and use. FIG. 7 shows the interlayer 56 coated over the hardcoat layer 52. This view shows the porosity of the interlayer 56 as pores 58 distributed within the interlayer. FIG. 7 also illustrates the roughness of the outer surface of the applied interlayer 56. This is of course only a schematic depiction not meant to indicate the actual size or shape of any of the illustrated features. In one embodiment, the interlayer 56 has a roughness parameter, $R_a$, in a range from 190-210. The roughness parameter may be in this range as applied, or the as-applied roughness parameter may be higher with a secondary operation being performed to lower the roughness parameter to a value within the desired range. For example, an abrasive pad (e.g. Scotch-Brite® or similar), sandpaper, or other suitable mild abrasive material may be used to knock down interlayer roughness peaks prior to application of the softcoat layer.

FIG. 8 shows the softcoat layer 54 coated over the hardcoat layer 52 and the interlayer 56. As previously noted, the material of the softcoat layer 54 is allowed to flow into the pores 58 during and/or after the softcoat material is applied, where it cures or otherwise solidifies to form an interlocking portion 60 of the coating system. In some embodiments, the flow of the softcoat layer 54 material into the porous underlying layer during the coating process may be pressure- or vacuum-assisted. A portion of the thickness of the softcoat layer 54 is thus co-located with the thickness of the interlayer, with the outermost portion of the softcoat layer being located at the outer surface of the coated component on top of the other layers. The applied softcoat layer 54 may optionally be lightly polished or burnished, or it may be used as applied. In one embodiment, an outermost portion of the softcoat layer 54 is polished away to expose at least a portion of the underlying interlayer 56 prior to being placed into service.

After application of the softcoat layer 54, the roughness parameter $R_a$ of the coated component is preferably 50 or lower, and the roughness parameter of the surface underlying the softcoat layer is higher than 50. In one embodiment, the application of the softcoat layer reduces the roughness parameter of the coated component by 140-160. Another embodiment includes adjusting the roughness of the coating system during application of the softcoat layer 54. For example, the softcoat layer may be partially applied, then subjected to a roughness adjustment to bring the roughness parameter down into a desired range prior to finishing the application of the softcoat layer. In one particular example, a liquid polymer-based coating material is applied over the interlayer 56. The liquid coating includes additives such as PTFE, moly, or other additives that can be lightly abraded without losing integrity. The liquid coating is applied in multiple coats. One to three light coats may be applied before allowing the liquid to flash dry at a temperature of about 200-300° F. to bring the applied material to a workable state—not necessarily fully cured, but with sufficient integrity to withstand light abrasion treatment. The surface roughness may be measured at this stage of the process. If the roughness is sufficiently high that the remaining softcoat layer material will likely not bring the roughness parameter down into the desired final range, then the surface of the coated component may be lightly sanded or abraded before the remainder of the softcoat layer material is applied. For example, if the partially-coated interlayer has a roughness parameter in a range from about 80-150 higher than the desired final roughness parameter, a roughness adjustment may be performed. In one particular example, the partially-coated interlayer is abraded until it is 20-40 points higher than the desired final roughness. This step can serve to smooth the peaks of carbide or other hard interlayer particles as well as polymer particles that may be present due to dry spray. Then, an additional one to three light coats of the liquid polymer material can be applied to the desired final thickness, flash-dried, and cured. The curing step may occur at a temperature higher than the flash-drying steps.

The interlocking portion 60 of the coating system is thus characterized by a mixture of hard and soft regions that can advantageously enhance the service life of fluid energy device components like mud rotors. By way of illustration, FIG. 9 shows the coating system after being placed into service in a fluid energy device. In this example, an outermost portion of the coating system has been worn away so that the outer surface 36 has changed from its original, as-manufactured location (shown as a dashed line in FIG. 9). As the softcoat layer 54 is worn away, as intended, roughness peaks from the interlayer 56 material become exposed at the surface 36 such that the surface 36 is made up of a mixture of soft surface regions 62 and hard surface regions 64. When the roughness peaks are first exposed at the surface 36, the hard surface regions 64 are distributed within a larger interconnected soft surface region 62. As the coating system is further worn away so that the outer surface is located within the interlocking portion 60 of the coating system, the outer surface will be made up of smaller soft surface regions 62 within a larger interconnected hard surface region 64. Eventually, the interlayer 56 may completely wear away so that the outer surface is made up of the hardcoat layer 52. In embodiments in which the interlayer is omitted as in FIG. 6, the softcoat layer 64 may also at least partly penetrate the hardcoat layer 52, though to a lesser extent, depending on the porosity of the hardcoat layer and other factors.

In this controlled-wear configuration, the wear-resistance of the coated component actually increases as coating material is worn away. In addition, the above-described coating system can allow the abrasiveness of the working fluid, such as drilling mud, to be used advantageously to polish or smooth the hard portions of the coating system during use and in a controlled manner, thereby eliminating the need to polish an applied hard coating in a way that protects the opposing device surface, such as the stator inner surface. In other words, while an abrasive working fluid could be used on a hardcoat layer alone to smooth or polish the outer surface of the rotor during use, the soft inner surface of the mating stator would be substantially damaged in the time required to sufficiently smooth the rotor surface. The more gradual exposure of the harder layers of material at the rotor surface depicted in FIG. 9 and in the above description can prevent such damage to the stator surface when the rotor is first put into service.

The softcoat layer material also fills the space in between the hard, sharp peaks of the rough surface of the harder underlying material so that the outer surface of the rotor is more continuous and the hard peaks cannot dig into the stator material. This more continuous rotor outer surface also allows for a higher quality seal between the rotor and stator, thereby providing for more efficient pump or motor operation, particularly during the initial stages of service. The softcoat layer material can also provide lubricity via polymer material composition (e.g., PTFE) or additives, providing smoother and cooler operation due to lower friction between the rotor and stator surfaces. This lower friction condition can allow for more efficient device operation that results in reduced energy loss when powering the device and/or during device start-up after an idle time. In addition, filling the porous portion of the harder underlying layers with corrosion-resistant softcoat layer material can reduce or eliminate the sub-surface corrosion sites to better protect the coating system from corrosion by the working fluid.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A coated component for use in a fluid energy device, comprising:

a component substrate;

a hardcoat layer of coating material being disposed over the component substrate and having a hardness greater than the hardness of the component substrate; and a softcoat layer of coating material being disposed over the hardcoat layer and having a hardness less than the hardness of the hardcoat layer, wherein the hardness of the softcoat layer is less than or substantially the same as the hardness of a mating component of the fluid energy device with which the coated component is in continuous contact during device operation.

2. The coated component as defined in claim 1, further comprising:

an interlayer of coating material being interposed between the hardcoat and softcoat layers and having a porosity greater than the porosity of the hardcoat layer.

3. The coated component as defined in claim 2, wherein pores of the interlayer are at least partially filled with softcoat layer material.

4. The coated component as defined in claim 1, wherein the hardcoat layer comprises a carbide compound.

5. The coated component as defined in claim 1, wherein the softcoat layer comprises a polymeric material.

6. The coated component as defined in claim 1, wherein an outer surface of the component includes a mixture of hard and soft surface portions, said hard surface portions comprising a carbide compound and said soft surface portions comprising a polymeric material.

7. The coated component as defined in claim 1, wherein material of the softcoat layer fills pores formed in the material of the hardcoat layer, at least some of the pores being located entirely below an outer surface of the coated component such that some of the material of the softcoat layer is covered by the material of the hardcoat layer.

8. The coated component as defined in claim 7, further comprising an interlayer of coating material interposed between the hardcoat and softcoat layers and having a porosity greater than the porosity of the hardcoat layer, wherein the interlayer comprises material of the hardcoat layer with said pores formed therein.

9. The A coated component as defined in claim 8, wherein the interlayer includes the material of the softcoat layer in an interlocking arrangement with the material of the hardcoat layer.

10. A subterranean drilling tool comprising a mud rotor comprising the coated component of claim 1.

11. A coated component for use in a fluid energy device, comprising:

a coating system coated over a component substrate, the coating system having an interlocking portion that includes a polymeric material in an interlocking arrangement with a metallic material, wherein the metallic material is harder than the component substrate, and wherein the polymeric material fills pores formed in the metallic material, at least some of the pores being located entirely below an outer surface of the coated component such that some of the polymeric material is covered by the metallic material in the interlocking portion.

12. The coated component as defined in claim 11, wherein the coating system is configured so that an outer surface of the component includes a mixture of hard and soft surface portions during at least a portion of the time the coated component is in use in the fluid energy device.

13. The coated component as defined in claim 11, wherein the coating system is configured so that an outer surface of the component becomes more wear-resistant as the coating system wears away during use in the fluid energy device.

14. A subterranean drilling tool comprising a mud rotor comprising the coated component of claim 11.

15. A coated component for use in a fluid energy device, comprising:

a component substrate;

a hardcoat layer of coating material being disposed over the component substrate and having a hardness greater than the hardness of the component substrate;

a softcoat layer of coating material being disposed over the hardcoat layer and having a hardness less than the hardness of the hardcoat layer; and an interlayer of coating material being interposed between the hardcoat and softcoat layers and having a porosity greater than the porosity of the hardcoat layer.

16. The coated component as defined in claim 15, wherein pores of the interlayer are at least partially filled with softcoat layer material.

17. The A coated component as defined in claim 15, wherein the hardness of the softcoat layer is less than or substantially the same as the hardness of a mating component of the fluid energy device with which the coated component is in continuous contact during device operation.

18. The A coated component as defined in claim 15, wherein the hardcoat layer comprises a carbide compound.

19. The A coated component as defined in claim 15, wherein the softcoat layer comprises a polymeric material.

20. A subterranean drilling tool comprising a mud rotor comprising the coated component of claim 15.

* * * * *